US006883523B2

(12) United States Patent
Dante

(10) Patent No.: US 6,883,523 B2
(45) Date of Patent: Apr. 26, 2005

(54) CIGARETTE HAVING POROUS HEAT TRANSFER TUBE

(75) Inventor: Henry M. Dante, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 47 days.

(21) Appl. No.: 10/366,349

(22) Filed: Feb. 14, 2003

(65) Prior Publication Data

US 2004/0159327 A1 Aug. 19, 2004

(51) Int. Cl.[7] ..... A24D 1/04
(52) U.S. Cl. ..... 131/363; 131/361; 131/360
(58) Field of Search ..... 131/361, 364, 131/363, 360

(56) References Cited

U.S. PATENT DOCUMENTS

| | | | |
|---|---|---|---|
| 3,356,094 | A | 12/1967 | Ellis et al. |
| 3,756,249 | A | 9/1973 | Selke et al. |
| 4,340,072 | A | 7/1982 | Bolt et al. |
| 4,732,168 | A | 3/1988 | Resce et al. |
| 4,924,886 | A | 5/1990 | Litzinger |
| 4,984,588 | A | 1/1991 | Stewart |
| 5,060,676 | A | 10/1991 | Hearn et al. |
| 5,458,107 | A | 10/1995 | Balogh et al. |
| 5,690,127 | A | 11/1997 | Chapman et al. |
| 5,954,061 | A | 9/1999 | Cardarelli |

OTHER PUBLICATIONS

Written Opinion for PCT/US04/04530 dated Aug. 5, 2004.
Notification of Transmittal of the International Search Report or the Declaration for PCT/US04/04530 dated Aug. 5, 2004.

*Primary Examiner*—Dionne A. Walls
(74) *Attorney, Agent, or Firm*—Burns, Doane, Swecker & Mathis, LLP

(57) ABSTRACT

A smoking article includes a cylinder of smoking material, a filter attached to the cylinder of smoking material, and a tube of preferably porous and/or perforated material adapted to collapse at an open end upon exposure to thermal energy and preferably extending from one end portion of the smoking material to the junction of the filter and the cylinder of smoking material. Thermal energy generated by a burning portion of the tobacco filler material within the cylinder of smoking material is transferred by convection through the open portion of the tube after the end portion of the tube has collapsed closed by the heat from the burning portion of the tobacco.

20 Claims, 2 Drawing Sheets

CIGARETTE HAVING POROUS HEAT TRANSFER TUBE

FIELD OF THE INVENTION

This invention relates to smoking articles in general and more particularly, to a smoking article having enhanced flavor delivery.

BACKGROUND OF THE INVENTION

In recent years there has been a tendency in the tobacco industry to produce tobacco products, particularly cigarettes, having filters with greater filtering efficiency and higher levels of dilution. This high filter efficiency and greater dilution reduces the total particulate matter or tar level of the cigarette and hence reduces the flavor to some extent.

Traditional, lit-end cigarettes comprise a cylindrical tobacco rod portion that is between 7.0 and 10.0 mm in diameter and 60 mm and 125 mm in length. The tobacco rod portion, which is composed of one or more selected types of cut tobacco, is wrapped in cigarette paper along its outer circumference. A filter, preferably of cellulose acetate or some other cellulosic material, is attached, in end-to-end relation, to the mouth end of the tobacco rod by a filter wrap. During puffs, smoke from the lit end of the cigarette travels the length of the tobacco rod and through the filter to the smoker.

U.S. Pat. No. 3,356,094 to Ellis et al., U.S. Pat. No. 4,340,072 to Bolt et al. and U.S. Pat. No. 4,732,168 to Resce et al. describe examples of smoking articles having a tobacco column with a tubular member therethrough, wherein the tube is filled with an aerosol releasing material. In these patents, smoke from the burning tobacco is mixed with the aerosol.

U.S. Pat. No. 4,924,886 to Litzinger discloses a smoking article having a central tube of an impermeable material located within a tobacco column, wherein the central tube contains a heat absorbing, porous non-tobacco substrate including a flavor releasing material. The flavor releasing material is mixed with the porous substrate and the flavor is volatile at the smoldering temperature of the tobacco in the tobacco column. An aerosol generating material also impregnates the porous substrate and becomes aerosolized by the heat generated by the smoldering tobacco.

In U.S. Pat. No. 4,984,588 to Stewart and U.S. Pat. No. 3,756,249 to Selke et al., a longitudinally extending tube is provided within the cigarette, surrounded by the tobacco filler material and an outer cigarette wrapper, with the longitudinally extending tube serving as an internal air passageway within the cigarette. In these known smoking articles, the central longitudinally extending tube is impermeable to air flow, and therefore serves to control the amount of dilution of the mainstream smoke depending on whether the impermeable tube is open to air flow or closed.

In U.S. Pat. No. 4,984,588 to Stewart, a smoking article is provided with a hollow, elongated tube of a combustible, heat fusible and air impermeable material that extends from approximately 5 mm from the mouth end of the filter to approximately 10 mm short of the end of the tobacco segment. As the cigarette is smoked, relatively undiluted smoke enters the tube during the initial several puffs and is delivered in a virtually unfiltered condition. After the first several puffs, the tube is melted shut and normal dilution occurs.

In view of the tendency for cigarettes to have greater filtering efficiency and higher levels of dilution, a cigarette structure that provides improved flavor delivery would be desirable. Furthermore, in the existing cigarettes provided with longitudinally extending tubes that remain open at an end to air flow through the tube, ambient air flows through the tube with very little resistance to the flow, and therefore any transfer of heat through the tube from the burning coal at the end of the cigarette would be negligible.

SUMMARY OF THE INVENTION

A cigarette according to an embodiment of the invention comprises a cylinder of smoking material or tobacco rod and a filter attached in end-to-end relationship to the cylinder of smoking material. The cylinder of smoking material has a hollow central tube of porous paper or other suitable material and tobacco filler between the hollow tube and an outer layer of cigarette wrapper paper. The filter element, which is cylindrical in shape and substantially conforms to the cross-sectional size and shape of the cylinder of smoking material can be constructed with several segments. One segment of the filter element can comprise a hollow tube of material such as cellulose acetate material, which is aligned with and connected end-to-end with the cylinder of smoking material. A further segment of the filter element can comprise capsules of a flavor material, wherein the flavor material is released by thermal energy. The filter element can also include a solid cylindrical segment of a filtering material, such as cellulose acetate at the mouth (buccal) end of the filter element.

The hollow central tube of porous or perforated material within the cylinder of smoking material is constructed to have the property of collapsing closed at one end when that end is heated by the burning coal of the cigarette. The tube extends within the cylinder of smoking material all the way from the filter element to the end of the cigarette opposite from the filter. When the cigarette is lit at the end opposite from the filter, the tobacco will combust as in a normal cigarette, generating smoke components and heat energy.

During a draw upon the cigarette, the flow in the cigarette takes place in two regions, one through the tobacco bed contained between the hollow tube and the outer cigarette wrapper paper, and the other through the burning coal and the hollow tube. Because the pressure drop in the hollow tube is extremely low compared to the pressure drop through the tobacco bed, hot air coming out of the burning coal into the hollow tube flows to the segment of the filter containing flavor capsules and delivers significant heat energy to the flavor capsules. When the end of the hollow tube near the burning coal is closed by the heat of the coal, the remaining portion of the tube toward the filter remains open and allows the flow of air into the tube as a result of its porosity and/or perforations. Heat is transferred through the hollow tube by convection from the burning coal at one end of the cigarette to the flavor capsule segment of the filter. The flavorant released by the application of this thermal energy to the flavor capsules is delivered through the remaining portion of the filter.

BRIEF DESCRIPTION OF THE DRAWINGS

A more complete appreciation of the invention and the advantages of the invention will be readily apparent by reference to the following detailed description, when considered in connection with the accompanying drawings wherein.

DESCRIPTION OF THE PREFERRED EMBODIMENTS

Figure 1:
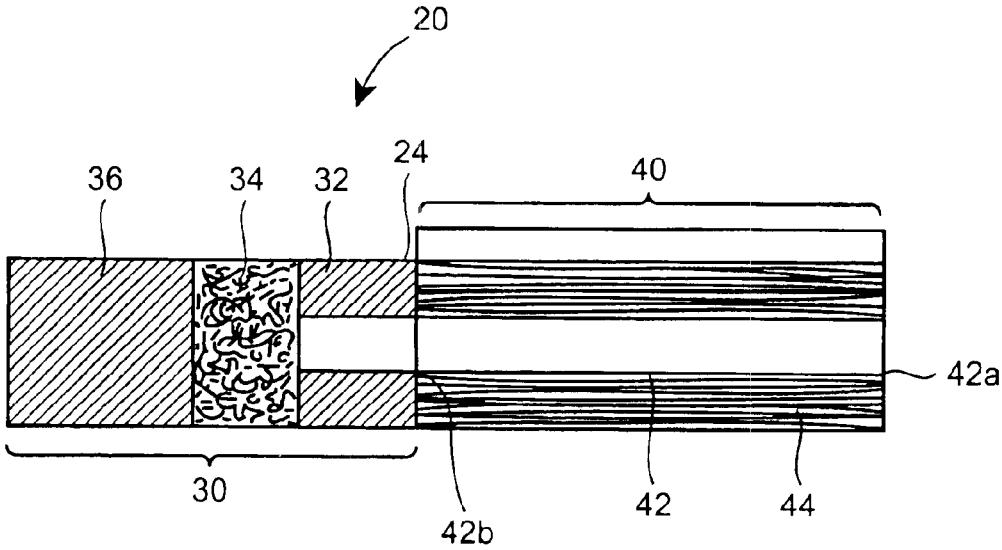
FIG. 1 is longitudinal cross-section of a cigarette according to an embodiment of the invention.

Referring initially to FIG. 1, a longitudinal cross-section of an embodiment of the invention is shown wherein a smoking article 20 includes a filter portion 30 and a cylinder of smoking material or tobacco rod 40. The cylinder of smoking material 40 can include a central hollow tube 42, surrounded by tobacco filler material 44, and an outer layer of cigarette wrapper (paper) 24 that extends from the cylinder of smoking material over the filter section and joins the filter section 30 to the cylinder of smoking material 40 in end-to-end relationship.

The central tube 42 within the cylinder of smoking material 40 preferably extends all the way to the end 42*a* of the cigarette opposite from the filter end of the cigarette. The end 42*b* of the tube 42 is preferably aligned with and abuts a hollow segment 32 of the filter portion 30.

The hollow segment 32 of the filter 30 provides a central air passageway leading from the hollow tube 42 of the cylinder of smoking material to a segment 34 of the filter that preferably includes flavorant adapted to be released by exposure to thermal energy. The filter portion 30 also includes a mouthpiece filter portion 36 of filtering material such as cellulose acetate tow.

Figure 2:
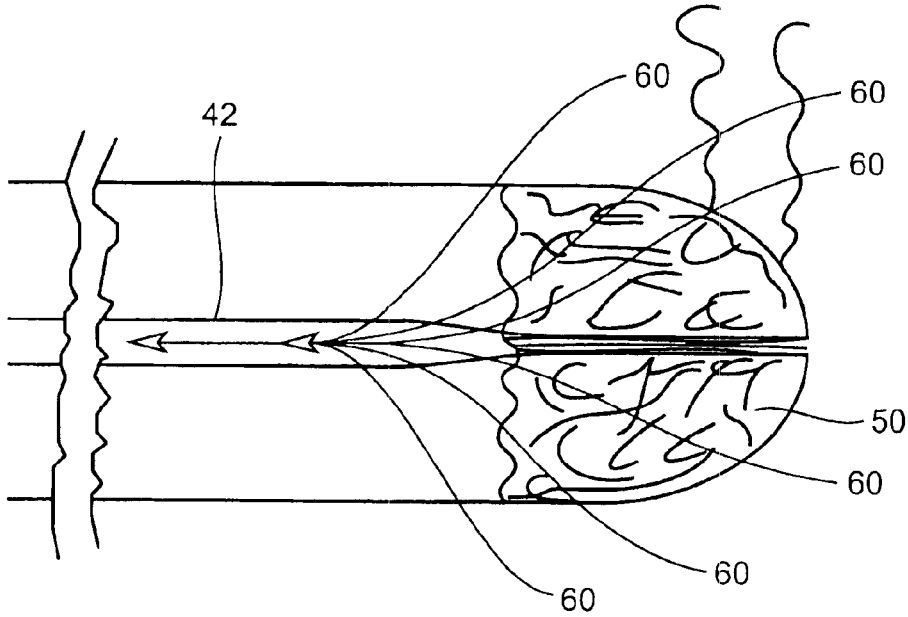
FIG. 2 is a schematic illustration showing the flow of air into the central hollow tube from the burning coal portion of a cigarette according to an embodiment of the invention.
Figure 3:
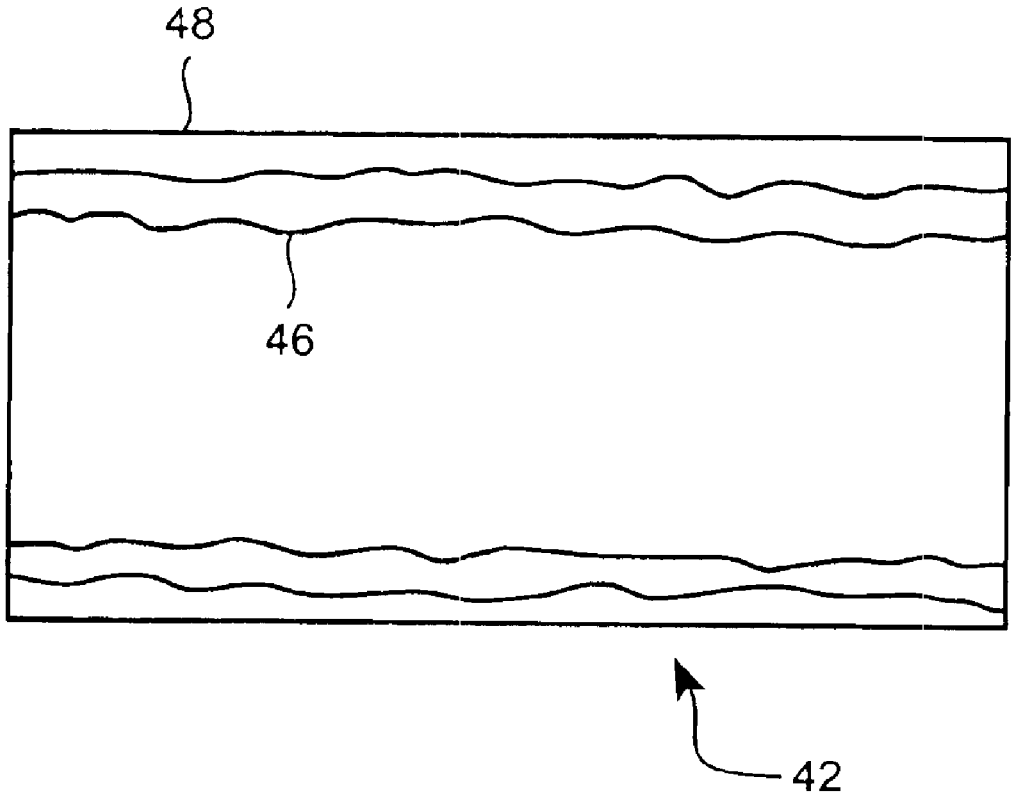
FIG. 3 illustrates an embodiment of a hollow tube according to the invention.

As illustrated in FIG. 2, the central hollow tube 42 of the cylinder smoking material 40 can be constructed such that heat applied to an end of the tube will cause the end portion of the tube to collapse upon itself and seal off (or close) the end of the tube. The collapsing feature can be achieved by a number of different embodiments of the hollow tube. In one alternative, such as shown in FIG. 3, the tube 42 can be constructed in a layered arrangement such that an outer or top layer 48 is made from a material having a higher thermal expansion coefficient than an inner or bottom layer 46. As a result, when the end of the tube is heated, the difference in thermal expansion coefficient between the two layers will result in the end portion of the tube collapsing upon itself and sealing off the end. The layers of the hollow tube can be constructed from different types of paper having the different thermal expansion coefficients. The difference in thermal expansion coefficients of the layers can be a result of the types of paper having different proportions of cellulose and/or different binders.

In the alternative, the tube is made of an axially oriented polymer structure, which when heated will collapse. One of the materials that could be used is carboxymethylcellulose (CMC). Another material that could be used is starch based film which has the property of collapsing when heated or burning.

Another arrangement includes two layers of material having the same or different thermal expansion coefficient, with a coating applied to either or both layers, or an intermediate layer of an encapsulated material between the layers wherein the coating material or intermediate layer of encapsulated material will vaporize upon exposure to thermal energy from the burning coal, and the expanding vapor will cause the inner layer to collapse on itself and seal off the end of the hollow tube.

The material from which the hollow tube is constructed can be selected not only for the feature of collapsing on itself upon exposure to the heat from the burning coal, but also such that is has a desired porosity to air. The porosity to air is preferably measured in CORESTA units (defined as the amount of air, measured in cubic centimeters, that passes through one square centimeter of material in one minute at a pressure drop of 1.0 kilopascals) as is known in the cigarette making industry, with the porosity preferably being greater than 10 CORESTA and less than 100 CORESTA. Alternatively, the material of the hollow tube can be perforated to achieve the desired CORESTA, allowing the flow of air through the wall of the tube as well as through the center, hollow portion of the tube.

Thermal energy from the burning coal 50 can enter into the hollow tube 42 at or near the end that collapses closed as a result of the heat from the burning coal. When the cigarette is lit and a puff up is drawn upon the cigarette, air flow in the cigarette takes place in two regions, one through the annular bed of tobacco filler material 44 contained between the tube 42 and the outer cigarette wrapper 24, and the other through the burning coal 50 and the hollow tube 42. This air flow is illustrated by arrows 60 in FIG. 2.

Because the resistance to flow and therefore pressure drop in the hollow portion of the tube 42 is extremely low compared to the pressure drop through the tobacco bed 44, the hot air coming out of the burning coal 50 flows most readily through the tube 42 and to the flavorant adapted to be released by exposure to thermal energy contained within segment 34 of the filter portion 30. As the cigarette is smoked the heat from the burning coal 50 progressively shrinks the end 42*a* of the central tube 42 and ensures that air entering the tube 42 is heated by the burning coal 50 rather than allowing cooler ambient air to enter the tube 42 through end 42*a*. Heat from the burning coal 50 is transferred through the tube 42 to the flavorant adapted to be released by exposure to thermal energy segment 34, thereby delivering significant thermal heat energy to the flavorant adapted to be released by exposure to thermal energy. Accordingly, a cigarette according to the invention enhances delivery of flavorants from the flavor capsules contained within segment 34 of the filter as a result of the convective heat transfer of thermal energy from the burning coal 50 through the central tube 42.

It will be understood that the foregoing description is of the preferred embodiments of the invention only and is, therefore, merely representative. Many variations and modifications of the present invention in light of the above teachings will be readily apparent to those skilled in the art. For example, the heat drawn from the burning coal 50 may be used to release or activate thermal-activated agents other than encapsulated flavors, such as thermally activated catalysts or absorbants. Accordingly, the exemplary embodiment of the invention, as well as alternative embodiments, may be made without departing from the spirit and scope of the invention as set forth in the attached claims.

What is claimed is:

1. A smoking article, comprising:

a cylinder of smoking material;

a filter attached to said cylinder of smoking material; and a tube having at least one end portion and the tube adapted to collapse at the at least one end portion upon exposure to heat generated by combustion of said smoking material, said tube extending from an end of the smoking article opposite to said filter to a juncture of said filter and said cylinder of smoking material.

2. The smoking article according to claim 1, wherein said smoking material comprises tobacco filler material that is contained between said tube and an outer layer of wrapper paper.

3. The smoking article according to claim 2, wherein said tube comprises heat shrink material, and heat generated by the burning of said tobacco filler material near said at least one end portion of said tube causes said tube to shrink and close at said at least one end portion.

4. The smoking article according to claim 3, wherein thermal energy generated by the burning portion of said tobacco filler material is transferred by convention through a remaining portion of said tube to said filter.

5. The smoking article according to claim 4, wherein air flow occurs more readily through said open portion of said tube than through the tobacco filler material surrounding said tube.

6. A smoking article, comprising:

a cylinder of smoking material;

a filter attached to the cylinder of smoking material, the filter including a heat activated agent; and a tube extending to a juncture of the filter and the smoking material and having at least one end portion, the tube being adapted to collapse at the at least one end portion upon exposure to heat generated by combustion of the smoking material, the heat activated agent activates when exposed to thermal energy communicated along the tube.

7. The smoking article according to claim 6, wherein said heat activated agent comprises a flavorant.

8. The smoking article according to claim 7, wherein said filter comprises a hollow segment aligned with said tube and providing a passageway from said tube to said flavorant adapted to be released by exposure to thermal energy.

9. A smoking article, comprising:

a cylinder of smoking material;

a filter attached to the cylinder of smoking material; and a tube extending to a juncture of the filter and the smoking material, the tube being made from a porous heat shrink material and adapted to collapse at at least one end portion thereof upon exposure to heat generated by combustion of the smoking material.

10. A smoking article, comprising:

a cylinder of smoking material;

a filter attached to the cylinder of smoking material; and a tube extending to a juncture of the filter and the smoking material, the tube being made from a heat shrink material that has been perforated, the tube being adapted to collapse at at least one end portion thereof upon exposure to heat generated by combustion of the smoking material.

11. A smoking article, comprising:

a cylinder of smoking material;

a filter attached to the cylinder of smoking material; and a tube extending to a juncture of the filter and the smoking material, the tube comprising two layers of material having different thermal expansion coefficients, the tube being adapted to collapse at at least one end portion thereof upon exposure to heat generated by combustion of the smoking material.

12. A smoking article, comprising:

a cylinder of smoking material;

a filter attached to the cylinder of smoking material; and a tube having at least one end portion and extending to a juncture of the filter and the smoking material, the tube comprising two outer layers of material and an intermediate material between the two outer layers, the tube being adapted to collapse at the at least one end portion upon exposure to heat generated by combustion of the smoking material, the intermediate material being adapted to vaporize upon exposure to heat generated by combustion of the smoking material.

13. The smoking article according to claim 12, wherein said intermediate material is applied as a coating to at least one of said outer layers of material.

14. The smoking article according to claim 12, wherein at least one of said two outer layers is adapted to collapse inwardly to seal off the at least one open end of the hollow tube as a result of pressure exerted by the vaporized intermediate material.

15. A method of making a smoking article, comprising:

forming a tobacco rod portion of the smoking article by placing tobacco filler material between a tube having at least one end portion adapted to collapse upon exposure to heat generated by combustion of said tobacco filler material and an outer layer of wrapper paper;

forming a filter portion of the smoking article having a plurality of segments with at least one of said segments comprising a heat activated agent that activates when exposed to thermal energy; and joining said tobacco rod portion in end-to-end relationship with said filter portion such that said tube provides at least a portion of a passageway from one end of said smoking article to said at least one segment of said filter portion comprising a heat activated agent.

16. The method according to claim 15, wherein:

said filter portion is formed from at least one hollow segment of a cellulose acetate material, at least one segment containing said heat activated agent and at least one solid segment of a cellulose acetate material.

17. The method according to claim 16, wherein said heat activated agent is flavorant.

18. The method according to claim 17, wherein:

said at least one hollow segment is joined in end-to-end relationship with said tube such that said passageway continues from said tube through said at least one hollow segment.

19. The method according to claim 18, wherein:

said flavorant is in the form of capsules positioned within said at least one segment and at one end of said passageway.

20. A smoking article comprising a filter and a tobacco rod, said tobacco rod including a tube extending from an end of the smoking article opposite to said filter toward said filter, said tube being constructed of a heat collapsible material such that upon lighting and drawing upon the smoking article so as to create a coal, an end portion of said tube collapses so as to promote communication of thermal energy from said coal to said filter.

* * * * *